US010293401B2

(12) United States Patent
Kao

(10) Patent No.: US 10,293,401 B2
(45) Date of Patent: May 21, 2019

(54) FULL-SERVO MULTI-AXIS MOLD CLAMPING DEVICE FOR DIE-CASTING MACHINE

(71) Applicant: T-SOK CO., LTD., New Taipei (TW)

(72) Inventor: Kun-Szu Kao, New Taipei (TW)

(73) Assignee: T-SOK CO., LTD., New Taipei (TW)

( * ) Notice: Subject to any disclaimer, the term of this patent is extended or adjusted under 35 U.S.C. 154(b) by 123 days.

(21) Appl. No.: 15/475,149

(22) Filed: Mar. 31, 2017

(65) Prior Publication Data

US 2018/0281056 A1 Oct. 4, 2018

(51) Int. Cl.
*B22D 17/20* (2006.01)
*B22D 17/26* (2006.01)

(52) U.S. Cl.
CPC ..... *B22D 17/20* (2013.01)

(58) Field of Classification Search
CPC ..... B22D 17/00; B22D 17/20; B22D 17/26; B22D 17/30; B22D 17/32; B22D 17/2015; B22D 17/2061
USPC ..... 164/303, 312, 316, 341, 342
See application file for complete search history.

(56) References Cited

U.S. PATENT DOCUMENTS

2015/0290705 A1* 10/2015 Nakatsuka ..... B22D 17/2015 164/312

* cited by examiner

*Primary Examiner* — Kevin P Kerns
(74) *Attorney, Agent, or Firm* — Leong C. Lei

(57) ABSTRACT

A full-servo multi-axis mold clamping device for a die-casting machine, including at least one main body, including a servo motor, actuating arm and mold fixing slide block, one end of the servo motor having a deceleration mechanism coupled eccentrically to the actuating arm, another end of the actuating arm being coupled pivotally to the mold fixing slide block; whereby, the actuating arm is driven to rotate to drive the mold fixing slide block to move to and fro when the servo motor is running.

3 Claims, 3 Drawing Sheets

FULL-SERVO MULTI-AXIS MOLD CLAMPING DEVICE FOR DIE-CASTING MACHINE

TECHNICAL FIELD OF THE INVENTION

The present invention relates to a mold clamping device, and more particularly to a mold clamping device used in a die-casting machine, the mold clamping device being moved back and forth by a servo motor used as a driving source.

DESCRIPTION OF THE PRIOR ART

Conventional die casting is pouring molten metal of better fusibility, such as aluminum, zinc, magnesium or copper alloy into a high heat-resistant metal mold in a fast high-pressure mechanical way, and then, solidifying it into shape rapidly by means of the lower temperature of the mold.

General high chamber die casting machines are mainly configured with a base, on which a mold is mounted, where a latch lock is configured on one side of the mold, and a fusion furnace located beside the base. In addition, an oil cylinder is configured above the fusion furnace, and a fusion furnace is in match connection with the latch lock of the mold through a discharge head, thereby pouring molten metal into a high heat resistant metal mold fast, mechanically with high pressure. However, since either a gas cylinder or oil cylinder is used as a power source in conventional die casting machines, the movement stroke and speed can not be precisely controlled, and must be adjusted by experienced personnel. In addition, oil cylinder will cause the working environment to be greasy.

SUMMARY OF THE INVENTION

The main object of the present invention is to provide a full-servo multi-axis mold clamping device for a die-casting machine, replacing a gas cylinder or oil cylinder with a servo motor, allowing the operation thereof to be more accurately, requiring no manual adjustment, and without noise generated by a pneumatic cylinder and greasiness yielded from a hydraulic cylinder.

To achieve the object mentioned above, the present invention proposes a full-servo multi-axis mold clamping device for a die-casting machine, including at least one main body, including a servo motor, actuating arm and mold fixing slide block, one end of the servo motor having a deceleration mechanism, coupled eccentrically to the actuating arm, another end of the actuating arm being coupled pivotally to the mold fixing slide block; whereby, the actuating arm is driven to rotate to drive the mold fixing slide block to move to and fro when the servo motor is running.

In addition, the full-servo multi-axis mold clamping device of the present invention allows a mold to be formed into a four-axis directional body, easy for mold development, and having large selectivity for parting lines; molten metal can be poured in a mold directly through parting lines without needing the flow dividing structure used in conventional die casting so that the cooling of the molten metal is fast, and then, energy and material saving effects can be achieved and the production speed can be increased.

DETAILED DESCRIPTION OF THE PREFERRED EMBODIMENTS

Figure 1:
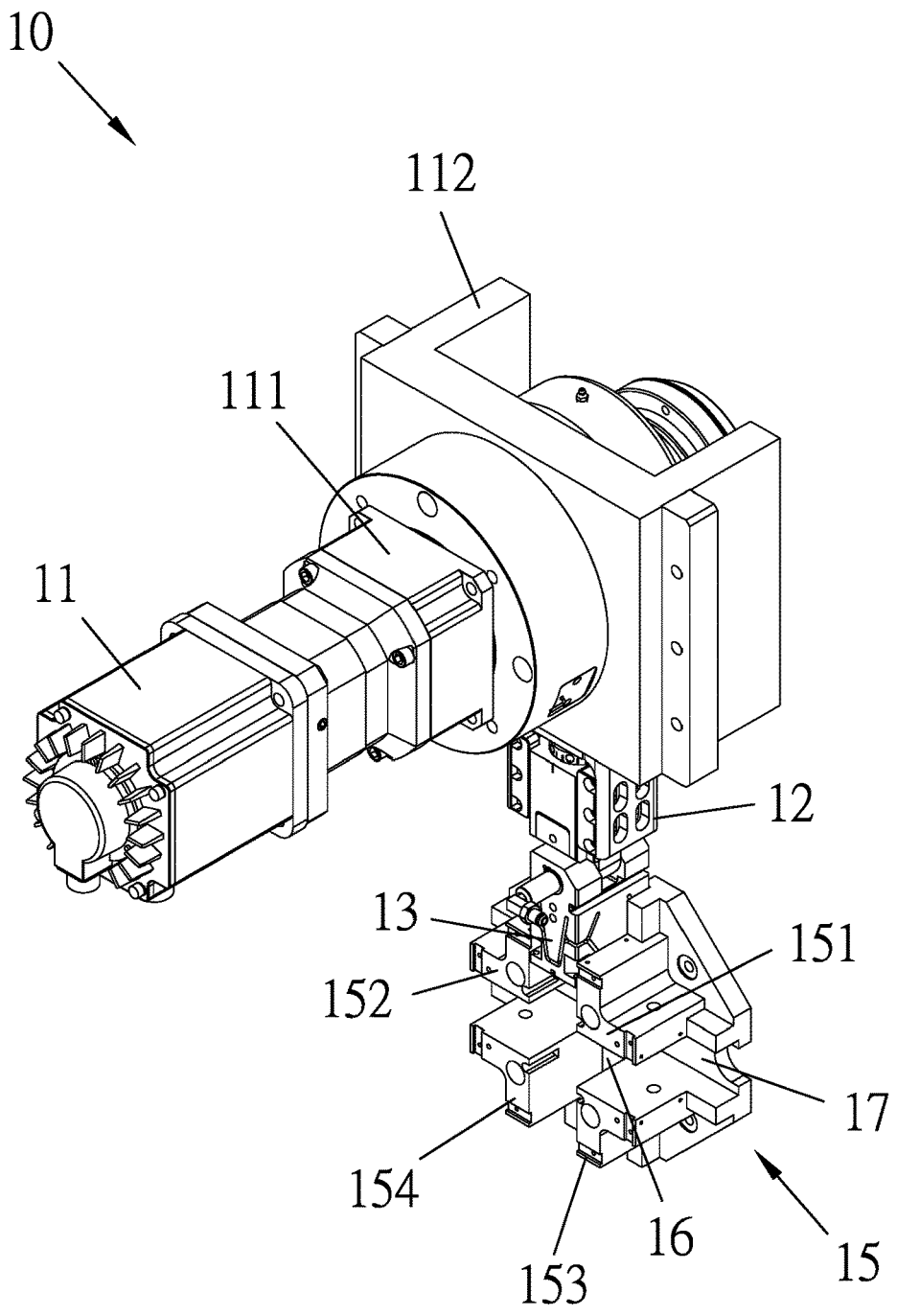
FIG. 1 is a perspective view of a preferred embodiment of the present invention.
Figure 2:
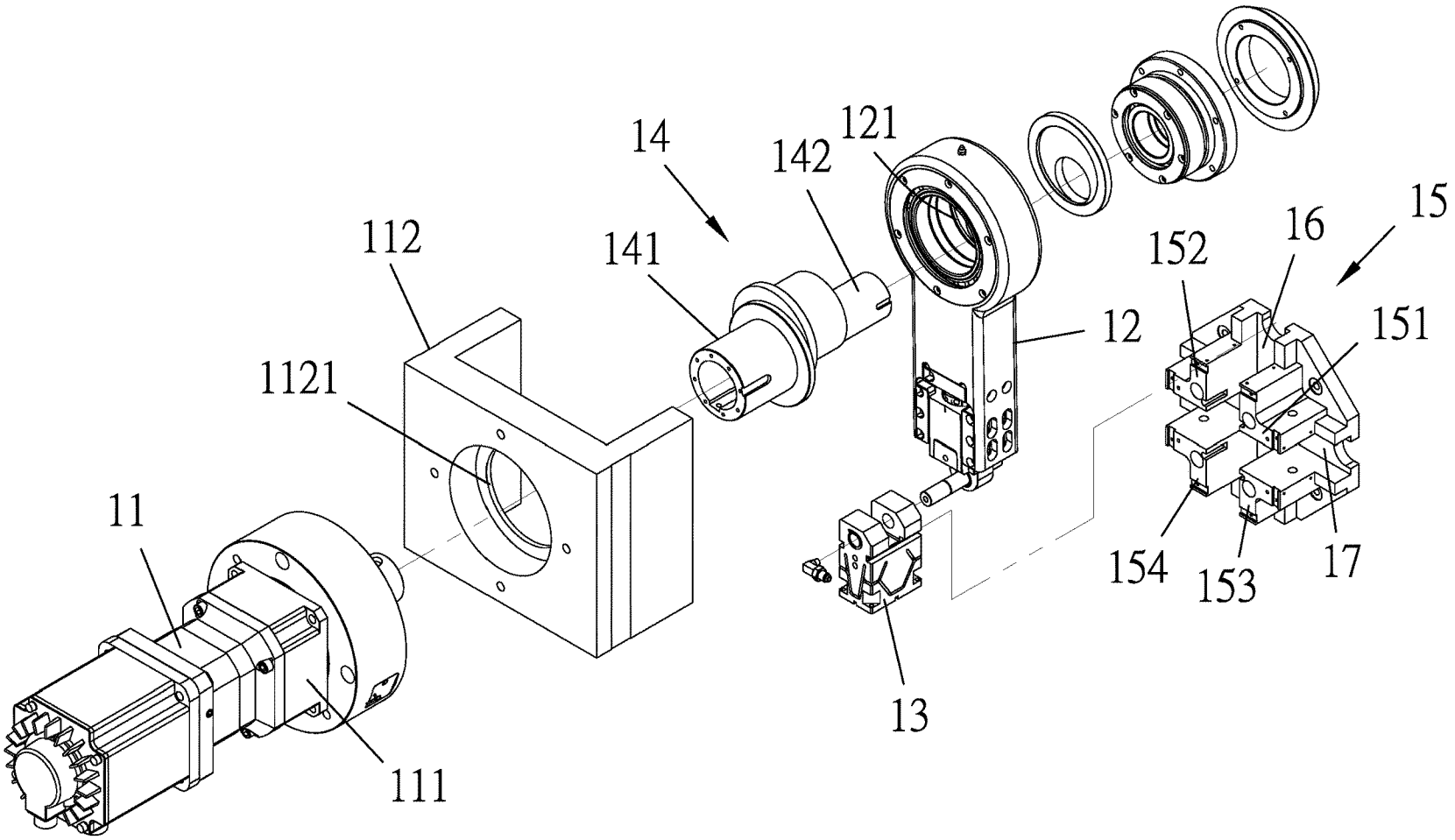
FIG. 2 is an exploded view of the embodiment of the present invention.

Referring to FIGS. 1 and 2, a full-servo multi-axis mold clamping device for a die-casting machine includes a main body 10.

The main body 10 includes a servo motor 11, actuating arm 12 and mold fixing slide block 13, where one end of the servo motor 11 is configured with a deceleration mechanism 111; the servo motor 11 is coupled to a frame 112 having a through hole 1121 allowing the deceleration mechanism 111 to be passed through.

The deceleration mechanism 111 is coupled pivotally eccentrically to the actuating arm 12, another end of which is coupled pivotally to the mold fixing slide block 13.

The deceleration mechanism 111 is further configured with an eccentric element 14, the two ends of which respectively have a first eccentric portion 141 and second eccentric portion 142, where the first eccentric portion 141 and second eccentric portion 142 are located on the same axis, the first eccentric portion 141 is coupled to the deceleration mechanism 111, and on end of the actuating arm 12 is configured with a shaft hole 121, in which the second eccentric portion 142 is inserted.

Furthermore, one end face of the mold fixing slide block 13 is configured slidably in a mold seat 15, inside which has at least two projecting portions 151, 152 between which one passage 16 is formed, where said one end face of the mold fixing slide block 13 is configured on the passage 16.

Referring to FIG. 1 again, the actuating arm 12 is driven to rotate to drive the mold fixing slide block 13 to move to and fro in the passage 16 through the structures mentioned above when the servo motor 11 is turned.

Figure 3:
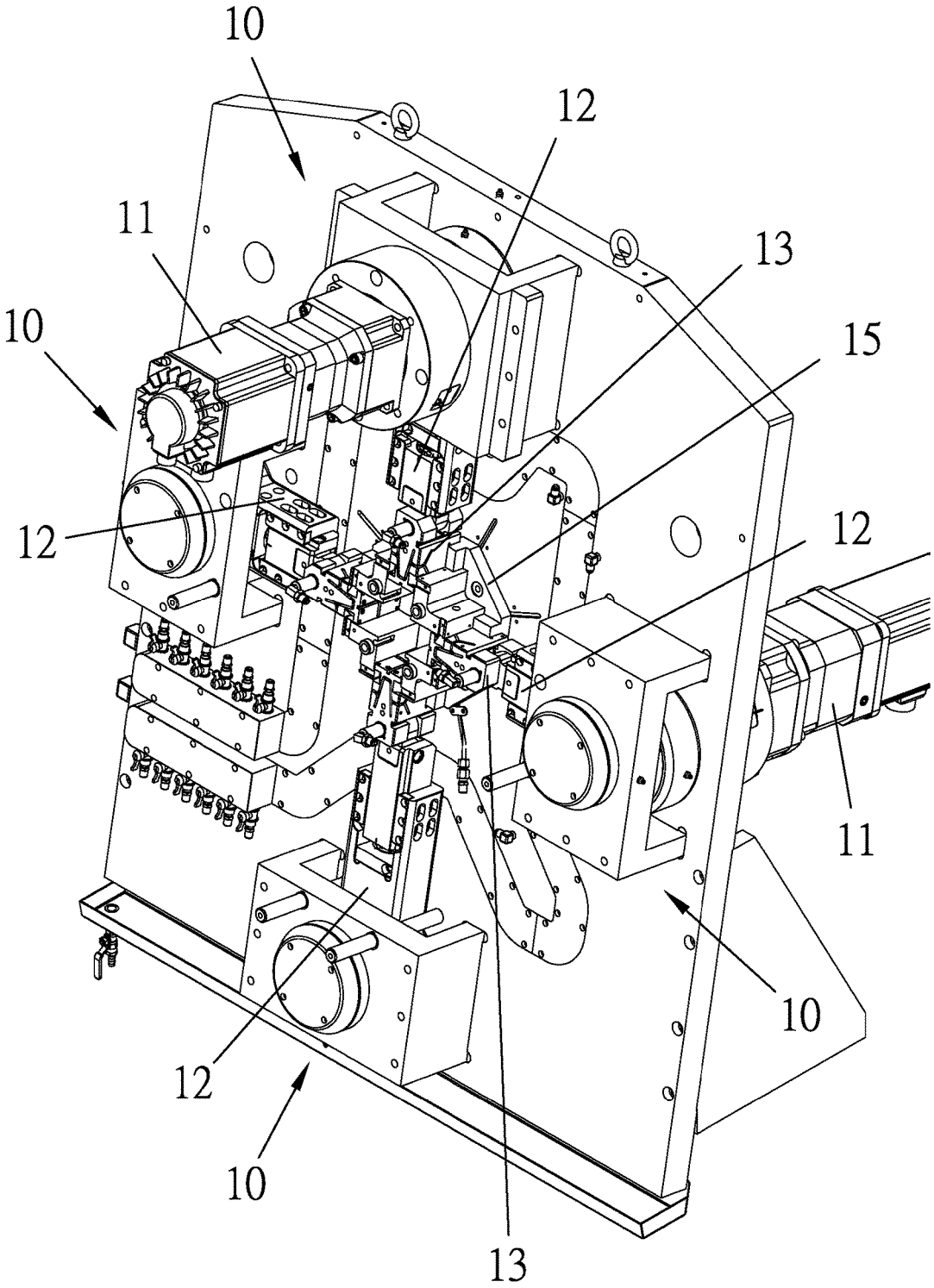
FIG. 3 is a perspective view of another preferred embodiment of the present invention, where a mold seat has four projecting portions.

Referring to FIG. 3, in another preferred embodiment, a mold seat 15 has four projecting portions 151, 152, 153 and 154 so as to form two passages 16 and 17 perpendicular to and crisscrossed with each other. The full-servo multi-axis mold clamping device of the present invention is respectively configured on the upper, lower, left and right of a die-casting machine, and the mold fixing slide block 13 of the main body 10 of each of the mold clamping devices is configured so as to slide to and fro in the respective passages 16 and 17.

I claim:

1. A full-servo multi-axis mold clamping device for a die-casting machine, comprising at least one main body, and further comprising a servo motor, actuating arm, and mold fixing slide block, one end of said servo motor having a deceleration mechanism coupled eccentrically to said actuating arm, another end of said actuating arm being coupled pivotally to said mold fixing slide block; whereby, the actuating arm is driven to rotate to drive said mold fixing slide block to move to and fro when said servo motor is running, wherein said deceleration mechanism is configured with an eccentric element, two ends thereof respectively having a first eccentric portion and second eccentric portion positioned on the same axis, said first eccentric portion is coupled to said deceleration mechanism, and one end of said actuating arm is configured with a shaft hole for insertion of said second eccentric portion therein.

2. The mold clamping device according to claim 1, wherein said servo motor is coupled to a frame configured with a through hole for insertion of said deceleration mechanism therein.

3. The mold clamping device according to claim 1, wherein one end of said mold fixing slide block is configured so as to slide in a mold seat, at least two projecting portions are configured in said mold seat, a passage is formed between said at least two projecting portions, and one end face of said mold fixing slide block is configured so as to slide in said passage.

* * * * *